United States Patent [19]

Funabashi et al.

[11] Patent Number: 5,025,726

[45] Date of Patent: Jun. 25, 1991

[54] MOVABLE INKER TYPE PRINTING MACHINE

[75] Inventors: Isao Funabashi; Toshihiko Ebina; Hiromitsu Numauchi, all of Toride, Japan

[73] Assignee: Komori Corporation, Tokyo, Japan

[21] Appl. No.: 486,214

[22] Filed: Feb. 28, 1990

[51] Int. Cl.[5] ..... B41F 31/36; B41L 27/38

[52] U.S. Cl. ..... 101/352; 101/247

[58] Field of Search ..... 101/207, 208–210, 101/349, 350, 351, 352, 247

[56] References Cited

U.S. PATENT DOCUMENTS

| | | | |
|---|---|---|---|
| 2,866,408 | 12/1958 | Stevenson | 101/352 X |
| 2,965,023 | 12/1960 | Boule et al. | 101/352 |
| 4,231,292 | 11/1980 | Stolle | 101/352 |

*Primary Examiner*—J. Reed Fisher

*Attorney, Agent, or Firm*—Abelman, Frayne, Rezac & Schwab

[57] ABSTRACT

An inker for a printing press is automatically detachable to the press when in a clutch-off position, and automatically connects itself to the press when a clutch-on instruction is received.

2 Claims, 14 Drawing Sheets

10
11
12
13
14
15
16
17
18
20
21
22
23
24
26
27
28
29
30
31
32
33
34
35
40
41
42
43
44
XII 18
40
52
51
53
VII
54
VII
55
54
16

FIG. 16
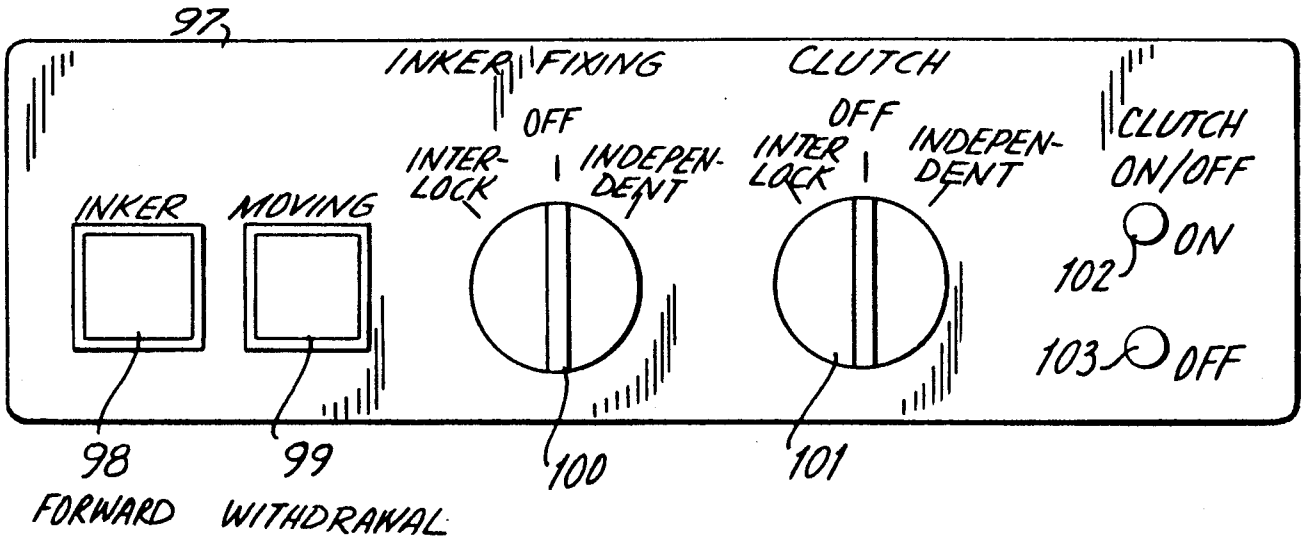
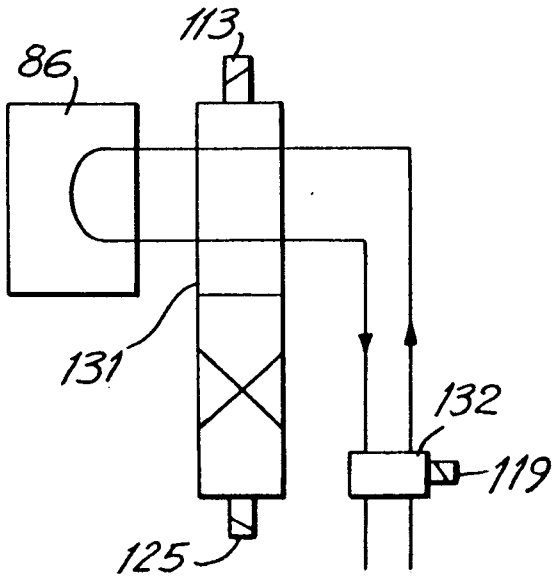
FIG. 17

MOVABLE INKER TYPE PRINTING MACHINE

BACKGROUND OF THE INVENTION

1. Field of the Invention

This invention relates to a printing machine having a detachable inker, more specifically to an improvement for easy attachment of an inker to a printing machine.

2. Description of the Related Art

A satellite-style web offset printing machine, for example, a Sammel printing press, generally has an inker which is movable and detachable with respect to the main printing unit.

A reason why such a detachable configuration is used is that the plate cylinder is necessary to be removed from the main unit at the time of printing pressure adjustment. Another reason is that the individual inking units in the inker must be independently driven for cleaning of inking rollers, ink feed, or nip width adjustment.

A drive mechanism of a prior art tricolor printing machine having a detachable inker will be briefly described with reference to FIG. 19. Referring to FIG. 19, in a printing machine main unit 1, a blanket cylinder 2 is supported on frames, and three plate cylinders 3 are disposed in contact with the outer peripheral surface of the blanket cylinder 2. At one axial end of each of plate cylinders 3 is integrally fixed a gear 4, and each gear 4 engages with a drive gear 5 to an inker 6.

The inker 6 is provided with inking units 7 of the same number as the plate cylinders 3. The individual inking units 7 are disposed according to the individual plate cylinders 3 so that when the inker 6 is attached to the main unit 1, a final inking roller 8 comes in contact with the printing plate surface of the individual plate cylinders 3 to feed ink.

In the inker 6, driven gears 9 of the same number as the plate cylinders 3 are supported on frames, and the individual driven gears 9 are connected to the individual inking units 7 via gears (not shown). These driven gears 9 are disposed relative to driving gears 5 so as to engage with the driving gears 5 when the inker 6 is attached to the main unit 1.

The inker 6 is placed on rotatable rollers 17 so that it can be moved to the right and left direction, and can be moved closer or farther relative to the main unit 1 by an inker moving device (not shown) using an actuator or by manual operation. Between the inker 6 and the main unit 1 is disposed a manual or actuator type fixing device (not shown).

Operation of the above printing machine will now be described. Suppose that the inker 6 is detached from the main unit 1. First, the inker 6 is moved manually or by the inker moving device forward to the vicinity of the main unit 1 where it is once stopped. Then, for positioning of the driving gears 5 and the driven gears 9, the teeth of both gears are aligned visually by the operator and the inker 6 is moved forward until the gears 5 and 9 come to engagement. With this condition, the fixing device is operated manually or by the actuator to fix the inker 6 to the main unit 1.

When printing operation is performed, a motor (not shown) of the main unit 1 is operated to rotate the blanket cylinder 2, the individual plate cylinders 3, and the individual driving gears 5. This causes the driving gears 5 to rotate the corresponding driven gears 9, the inking rollers 8 of the individual inking units 7 are rotated, and ink is supplied from the individual inking rollers 8 to the printing plate surface of the corresponding plate cylinders 3, thus making printing from the blanket cylinder 2 to paper.

To remove the inker 6 from the main unit 1, both units are unlocked, and then the inker 6 is moved to a predetermined withdrawal position.

In the prior art movable inker type printing machine, when the inker 6 is attached to the printing machine main unit 1, phase alignment between the driving gears 5 and the driven gears 9 must be made visually, thus involving very poor workability. Due to such visual operation, gear engagement may sometimes be poor, which lead to damages to the gears 5 and 9.

Furthermore, there must be provided an open space around the gears 5 and 9 for visual operation, an oil shower lubrication system cannot be used for the mechanism.

In addition, due to the visual operation, attachment of the inker 6 to the printing machine main unit 1 cannot be automated.

SUMMARY OF THE INVENTION

A first object of the present invention is to provide a movable inker type printing machine which enable automatic engagement of driving and driven gears without visual alignment of the gear teeth.

A second object of the present invention is to provide a movable inker type printing machine which can automate a series of operations for attaching an inker.

In accordance with the present invention which attains the above first object, there is provided a movable inker type printing machine comprising a printing machine main unit having a driving gear and an movable inker having a driven gear engaging with the driving gear and being detachable from the main unit; characterized by a gear clutch device having, among from the driving and driven gears, one movable gear disposed movably in the axial direction and the other fixed gear disposed fixedly in the axial direction for moving by an instruction the movable gear between a clutch-on position where the movable gear correctly engages with the fixed gear and a clutch-off position where the movable gear does not engage with the fixed gear, a device for outputting to the gear clutch device a clutch-on instruction to move the movable gear from the clutch-off position to the clutch-on position, a first detector for detecting whether or not the movable gear is at the clutch-off position, a second detector for detecting engagement of the movable gear with the fixed gear, a timer which operates when output of the first detector changes from detection of the clutch-off position to non-detection while the clutch-on instruction is being outputted, and a motor control device for operating a motor to rotate the driving gears at a lower speed than a speed for printing operation for a period from the time-up of the timer to engagement detection of the second detector and stopping the motor after detection of the engagement.

In accordance with the present invention which attains the above second object, there is provided a movable inker type printing machine comprising a printing machine main unit having a driving gear and an movable inker having a driven gear engaging with the driving gears and being detachable from the main unit; characterized by a gear clutch device having, among from the driving and driven gears, one movable gear disposed movably in the axial direction and the other fixed gear disposed fixedly in the axial direction for moving by an instruction the movable gear between a clutch-on position where the movable gear correctly engages with the fixed gear and a clutch-off position where the movable gear does not engage with the fixed gear, an inker moving device for moving by an instruction the inker between a forward position where the driven gears are engageable with the driving gears and a withdrawal position where the driven and driving gears do not engage, an inker fixing device for fixing the inker at the forward position to the printing machine main unit and releasing the fixing, a device for outputting an inker forward instruction to the inker moving device, an inker fixing instruction device for detecting the presence of the inker at the forward position and outputting an inker fixing instruction to the inker fixing device, a clutch-on instruction device for outputting a clutch-on instruction to the gear clutch device in response to the inker fixing instruction, a first detector for detecting whether or not the movable gear is at the clutch-off position, a second detector for detecting engagement of the movable gear with the fixed gear, a timer which operates when output of the first detector changes from detection of the clutch-off position to non-detection while the clutch-on instruction is being outputted, and a motor control device for operating a motor to rotate the driving gears at a lower speed than a speed for printing operation for a period from the time-up of the timer to engagement detection of the second detector and stopping the motor after detection of the engagement.

The above first invention has the following functions. When a clutch-on instruction is applied to the gear clutch device, the movable gear begins to move from the clutch-off position towards the clutch-on position. At this moment, if the teeth of the movable gear and the fixed gear are fortunately aligned, both gears begin to engage after a delay of time for the operation of the relevant mechanical system, and engagement is completed at the clutch-on position. However, this is a very rare case.

In the first invention, when the movable gear begins to separate from the clutch-off position, the timer operates by the output of the first detector and, after waiting the mechanical delay by the timer, the motor control device operates the motor to rotate the driving gear at a low speed. By the low-speed rotation, there occurs a chance of alignment between both gears, phase alignment is automatically achieved, and the movable gear automatically begins to come in engagement with the fixed gear. After that, the motor rotation becomes unnecessary, the motor control device stops the motor operation in response to the output of the second detector.

Therefore, in the first invention, with the movable gear at the clutch-off position, the inker can be moved forward manually or by a mechanical force to a position where the driving gears and the driven gears are engageable, then the clutch-on instruction causes both gears to engage automatically. Thus, there is no need for visual alignment of the gear teeth.

Next, functions of the second invention will be described. When an inker forward instruction is applied to the inker moving device, the inker begins to move from the withdrawal position to the forward position. When the inker reaches the forward position, the inker fixing instruction device gives the inker fixing device an inker fixing instruction to fix the inker to the printing machine main unit. This causes the driven gears to come to a position where they are engageable with the driving gears. Furthermore, in response to the inker fixing instruction, the clutch-on instruction device gives the gear clutch device a clutch-on instruction to achieve automatic engagement of the driven gears and the driving gears, as with the first invention.

Therefore, with the second invention, so long as the movable gear is at the clutch-off position, merely an inker forward instruction can be given to automatically perform a series of inker attachment operations including forwarding and fixing of the inker and gear engagement.

BRIEF DESCRIPTION OF THE DRAWINGS

FIGS. 1 to 18 relate to embodiments of the present invention.

FIG. 1 is a circuit diagram of a control system of an embodiment of the present invention.

FIG. 2 is a flow chart of inker attachment.

FIG. 3 is a flow chart of inker detachment.

FIG. 4 is a schematic view showing the entire of a printing machine.

FIG. 5 is a schematic view showing structure of an inker viewed from the rearside of FIG. 4.

FIG. 6 is a schematic view showing an inker moving mechanism.

FIG. 7 is a schematic cross sectional view taken along line VII—VII in FIG. 6.

FIG. 8 is a schematic cross sectional view showing an inker fixing mechanism.

FIG. 9 is a schematic side view of FIG. 8.

FIG. 10 is a schematic plan view of FIG. 8.

FIG. 11 is a schematic view showing a gear train of a gear clutch device.

FIG. 12 is a schematic cross sectional view showing the gear clutch device.

FIG. 13 is a schematic cross sectional view taken along line XIII—XIII in FIG. 12.

FIG. 14 is a schematic view showing a clutch position detecting mechanism viewed from a direction XIV in FIG. 12.

FIG. 15 is a schematic view taken along line XV—XV in FIG. 14.

FIG. 16 is a schematic front view of a control panel.

FIG. 17 is a schematic view showing a hydraulic system of a clutch hydraulic cylinder.

FIG. 18 is a control circuit diagram of another embodiment of the present invention.

DESCRIPTION OF THE PREFERRED EMBODIMENTS

Figure 1:
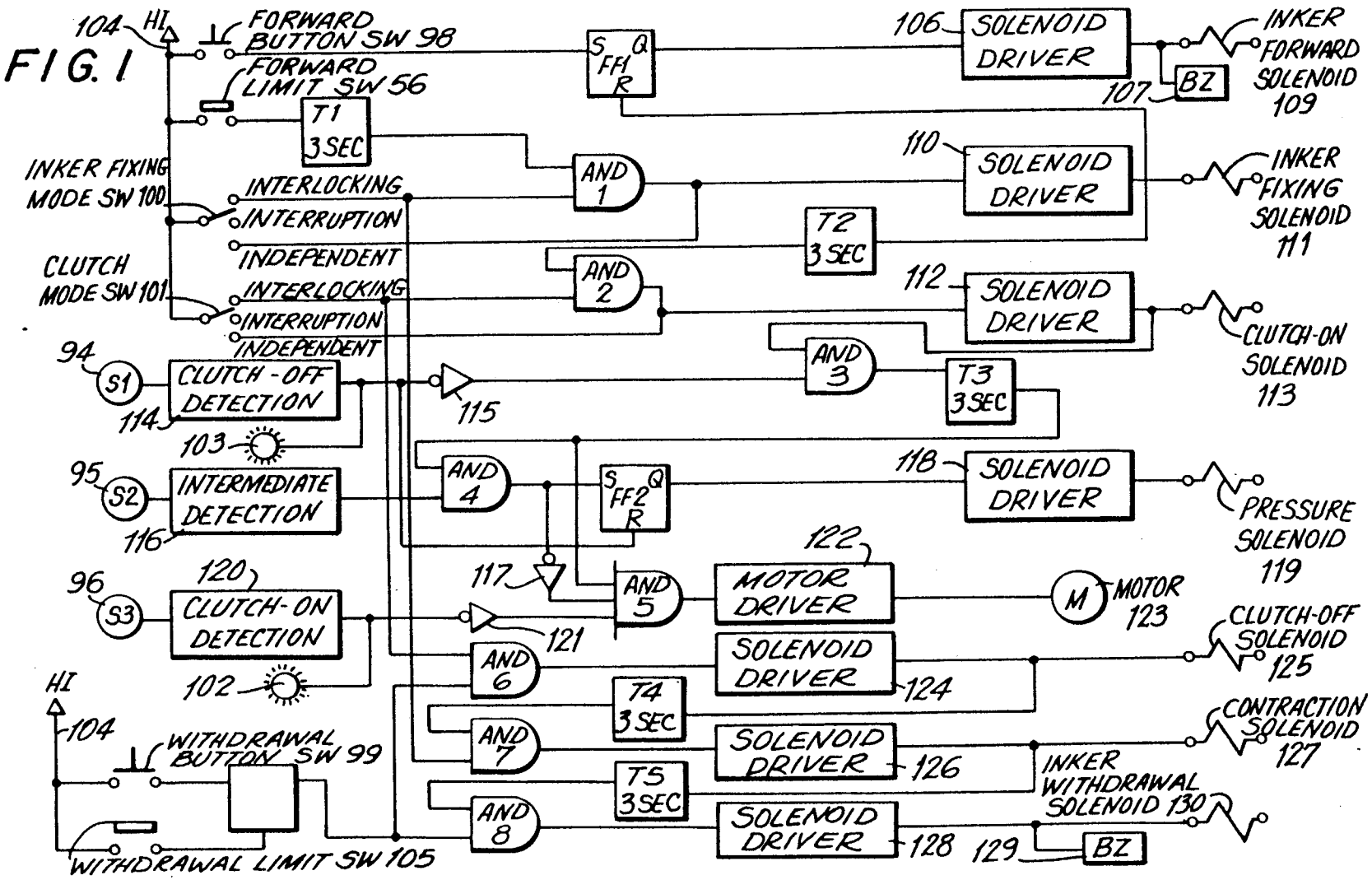
Figure 18:
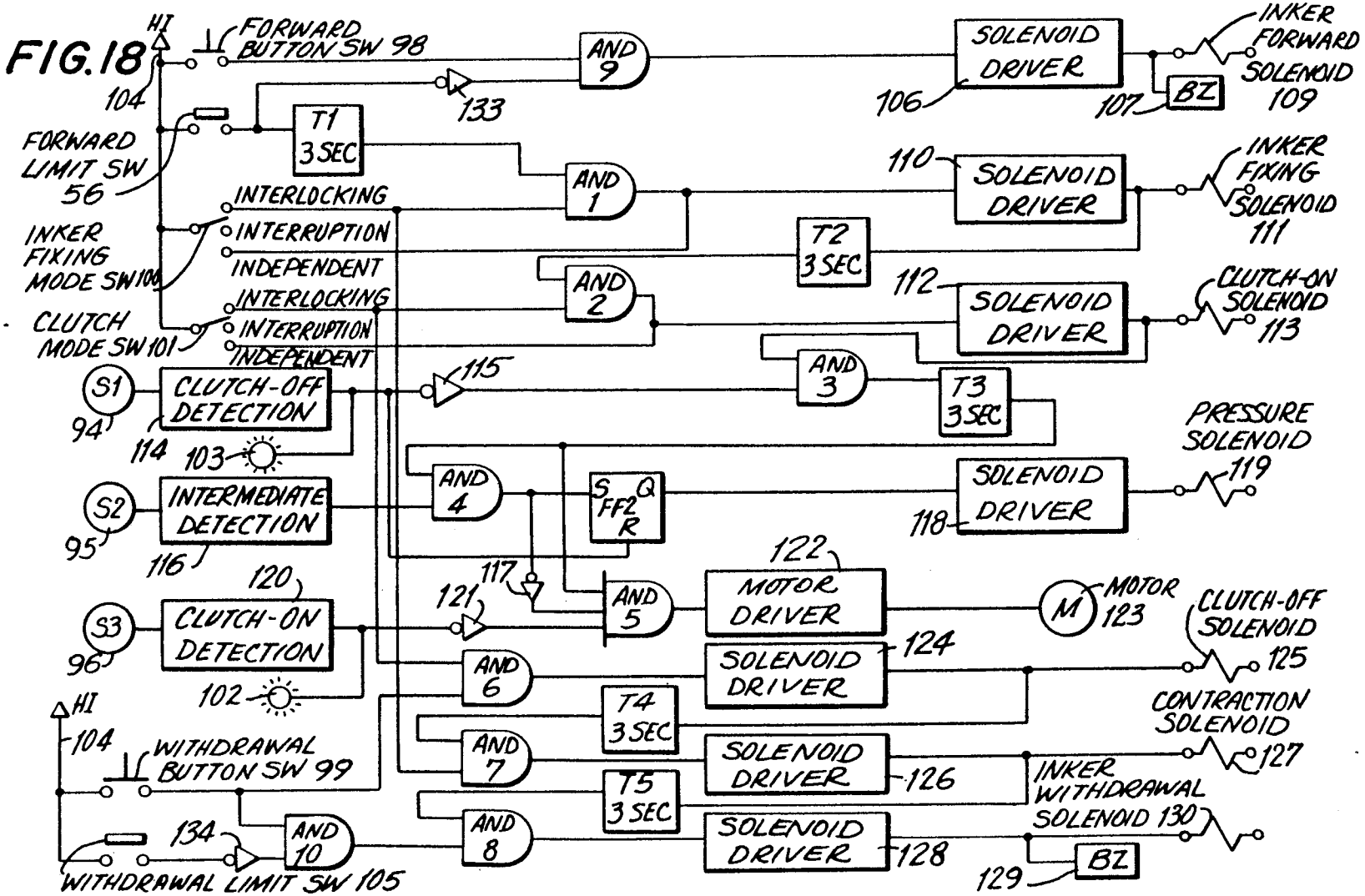
Figure 19:
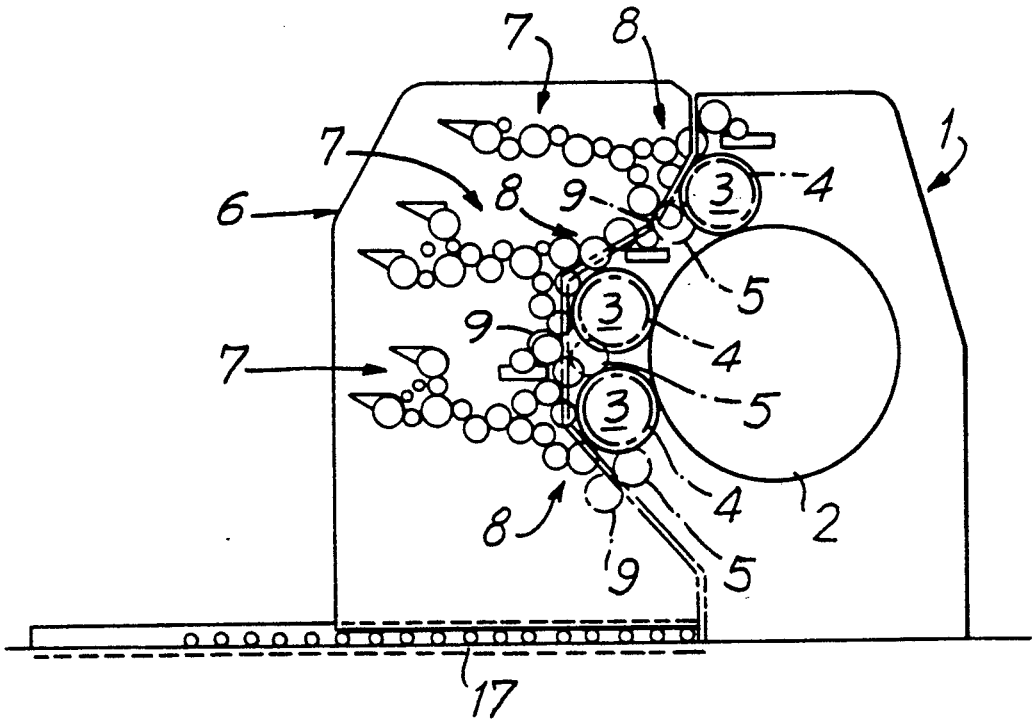
FIG. 19 is a schematic view showing a prior art printing machine.

Preferred embodiments of the movable inker type printing machine according to the present invention will now be described with reference to FIGS. 1 to 18. FIG. 1 and FIG. 18 are control circuit diagrams, which will be described later together with flow charts in FIG. 2 and FIG. 3. First, the mechanism of the printing machine will be described.

Figure 4:
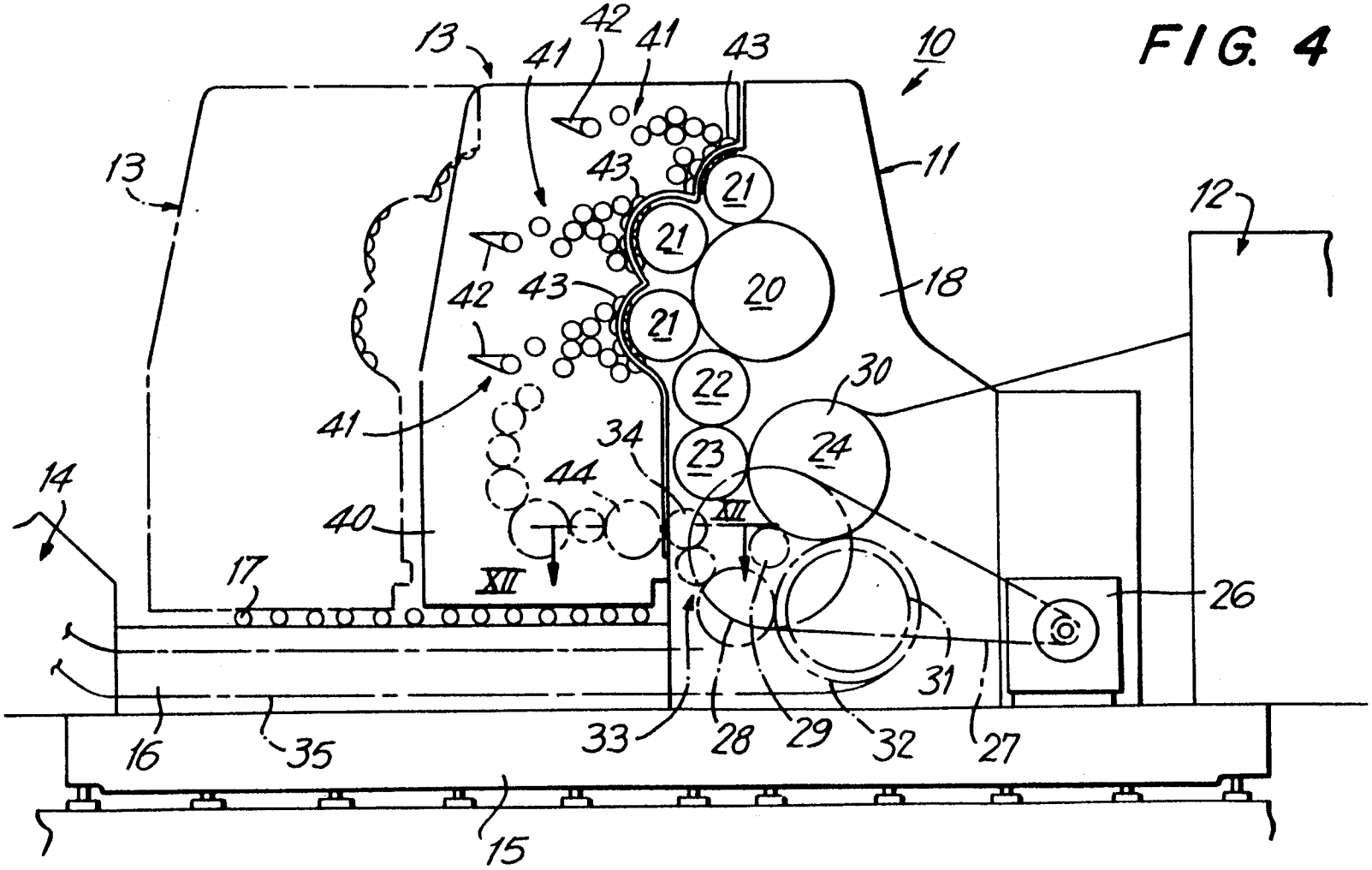

Referring to FIG. 4, a printing machine 10 is a satellite type offset printing machine, which comprises a paper feed device 12 and a paper discharge device 14, in addition to a main unit 11 and a movable type inker 13. The paper feed device 12 and the paper discharge device 14 have no direct relation to the present invention and description thereof will be omitted.

The inker 13 is supported movably in the right and left directions on rollers 17 which are rotatably disposed on a table 16 of the printing machine main unit 11 fixed onto a bed 15, whereby it can be brought closer or farther with respect to the main unit 11.

The structure of the main unit 11 will be described. The main unit 11 has right and left frames 18. A collecting blanket cylinder 20 is axially supported between the frames 18, and three plate cylinders 21 and a collecting plate cylinder 22, contacting against the outer peripheral surface of the collecting blanket cylinder 29, are axially supported between the frames 18. Peripheral surfaces of the individual plate cylinders 21 are provided with printing plates. The collecting plate cylinder 22 is in contact successively against a blanket cylinder 23 and an impressing cylinder 24 which are also axially supported between the frames 18. In this printing machine 10, ink on the collecting blanket cylinder 20 is applied to the collecting plate cylinder 22, from which the ink is once transferred to the blanket cylinder 23 and then printed on paper.

Each one axial end of the cylinders 20, 21, 22, 23, and 24 of the main unit 11 has a gear, and the gears are engaged with each other to enable synchronized rotation. The individual gears are housed in a gear case attached to the outside of the frame 18. Thus, in the printing machine of this embodiment, the gears of the individual cylinders are located outside the frame 18 and encased in the gear case to protect the gears from dust, and lubricated by an oil shower system in which oil sucked up from an oil tank is flowed down from the upper side in the gear case.

The printing machine main unit 11 has a motor 26, which is connected to a pulley 28 via a belt 27. A gear 29 integral with the pulley 28 engages with a gear 30 which is attached to one end of the impression cylinder 24 and has the same diameter, thus connected to the gears of the individual cylinders 20, 21, 22, and 23. By the operation of the motor 26, the individual gears and thus the individual cylinders are rotated. Provided, however, that the motor 26 is of a high-speed driving type for printing operation and, in this embodiment, a separate low-speed motor (not shown) is connected via a clutch (not shown) for use in attaching the inker, instead of the motor 26. The gear 30 of the impression cylinder 30 is engaged with a gear 32 integral with a sprocket 31, and the gear 32 is connected to a driving gear 34 to transmit a driving force to the inker 13 via a gear train 33. The sprocket is connected with a chain 35, and a claw (not shown) attached to the chain 35 grips and feeds a printed paper to the paper discharge device 14.

The driving gear 34 is a component of the gear clutch device and is supported movably in the axial direction, which will be described later with reference to FIG. 12. Therefore, in this embodiment, the driving gear 34 corresponds to a movable gear.

Next, the structure of the inker 13 will be described. Referring to FIG. 4, the inker 13 has three inking units 41, and each inking units has a group of rollers axially supported between right and left frames 40. At the front end of the roller group of each inking unit 41 is provided an ink fountain 42, and a set of four final inking rollers 43 of the roller group are disposed to contact against the individual plate cylinders 21 of the main unit 11.

Figure 5:
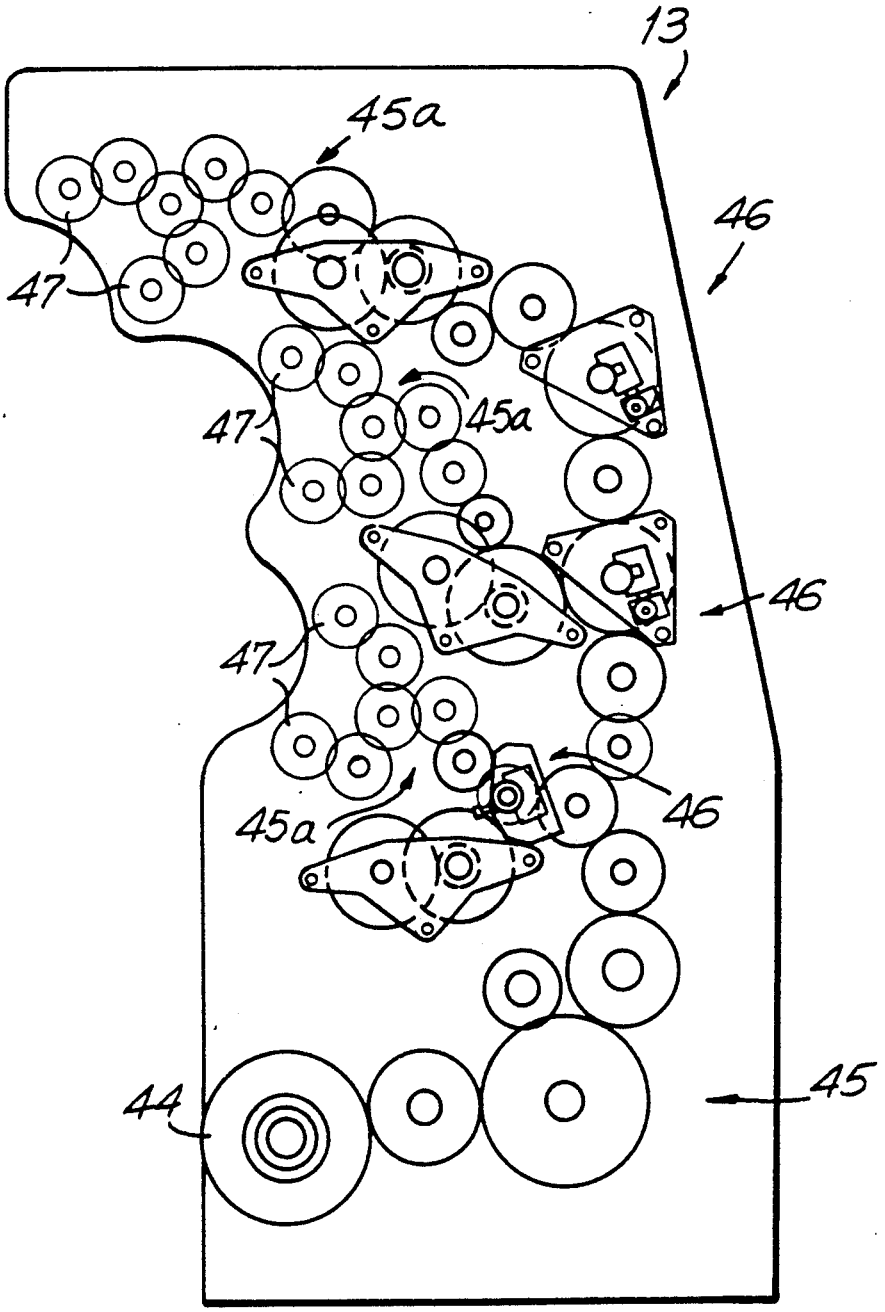

As shown in FIG. 5 which shows a backside view of FIG. 4, at one axial end of each inking roller of each inking unit 41 is provided a gear, and the individual gears are engaged with each other and housed in a gear case outside the frame 40.

Referring to FIG. 5, beneath the the inker 13, a driven gear 44 is disposed engageably with the driving gear 34 of the main unit 11. The driven gear 44 is supported fixedly in the axial direction, and is connected to gears 47 integral with inking rollers before the final inking rollers 43 of the individual inking units 41 via three gear trains 45, three clutches 46, and three gear trains 45*a*. Therefore, in this embodiment, the driven gear 44 corresponds to the fixed gear. The clutches 46 are provided so that, when only one or two of the three colors are used for printing, driving of unused inking roller(s) 43 is interrupted to stop feeding of ink of unnecessary color(s).

A driving connection section between the driving gear 34 of the main unit 11 side and the driven gear 44 of the inker 13 side will be described with reference to FIGS. 6 to 15.

Figure 6:
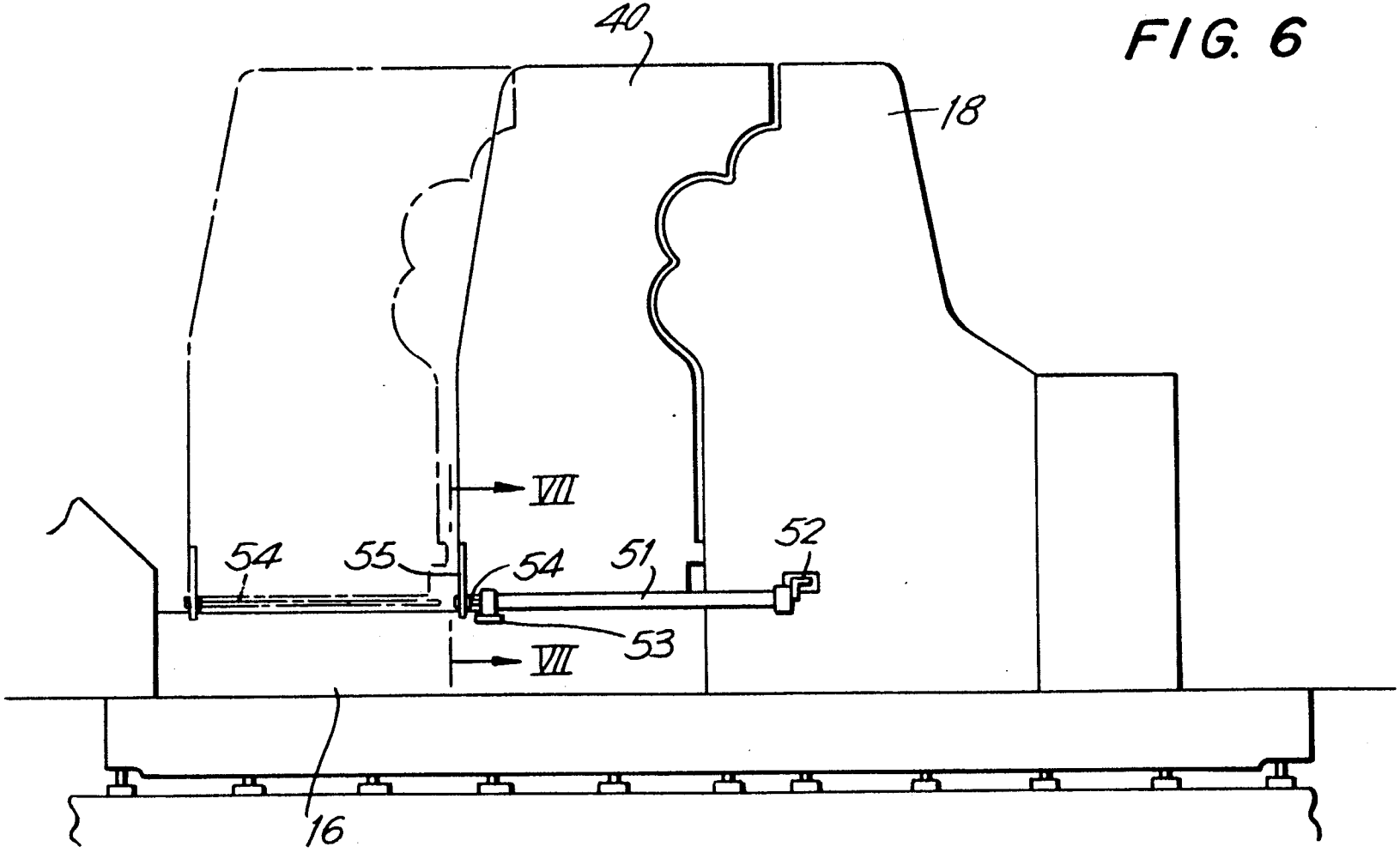
Figure 7:
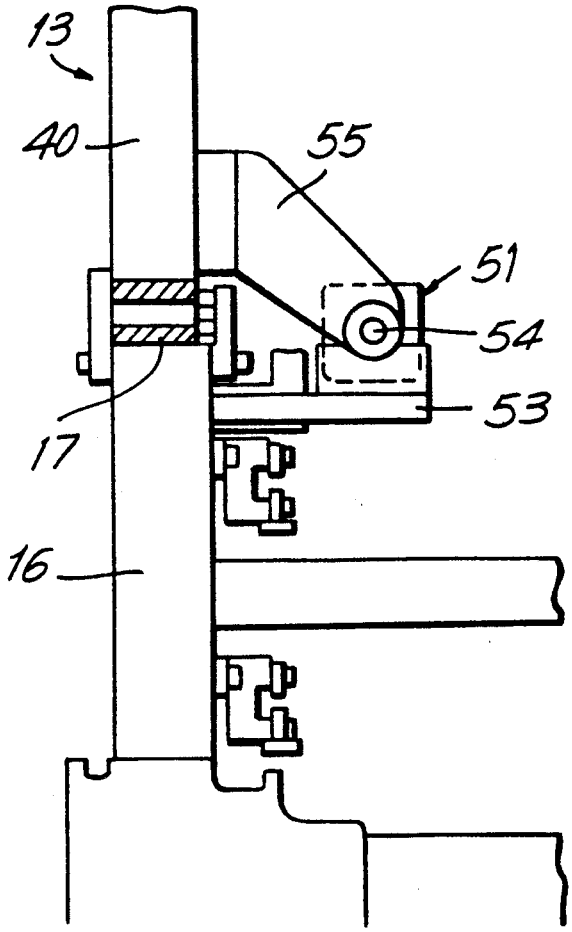

Linkage and separation between the driving gear 34 and the driven gear 44 is made in association with linkage and separation of the inker with respect to the main unit 11. Movement of the inker 13 is performed by an inker moving hydraulic cylinder 51 disposed between the main unit 11 and the inker 13. As shown in FIG. 6 which is a schematic view of the frames 18 and 40 of the printing machine 10 and FIG. 7 which is a view along line VII—VII in FIG. 6, the inker moving hydraulic cylinder 51 is disposed from the inner side surface of the frame 18 of the main unit 11 to the inner side surface of the table 16 via brackets 52 and 53, and front end of a piston rod 54 is connected to the frame 40 of the inker 13 via a connecting plate 55. Therefore, by the operation of the inker moving hydraulic cylinder 51, the inker 13 is moved on the rollers 17 with respect to the printing machine main unit 11, to link or separate. In FIG.6, the inker 13 shown by solid lines indicates the linked state, and that shown by two-dot-bar lines indicates the separated and standby state. The inker moving hydraulic cylinder 51 is provided one each on both sides.

Figure 8:
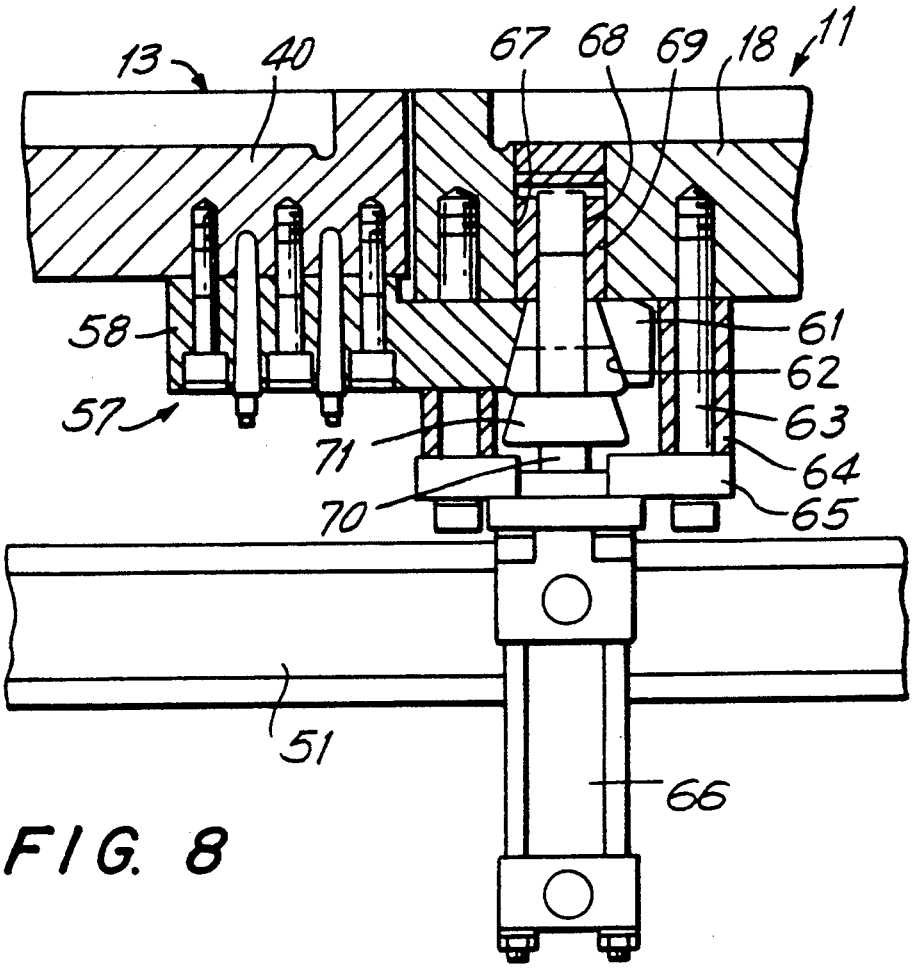
Figure 9:
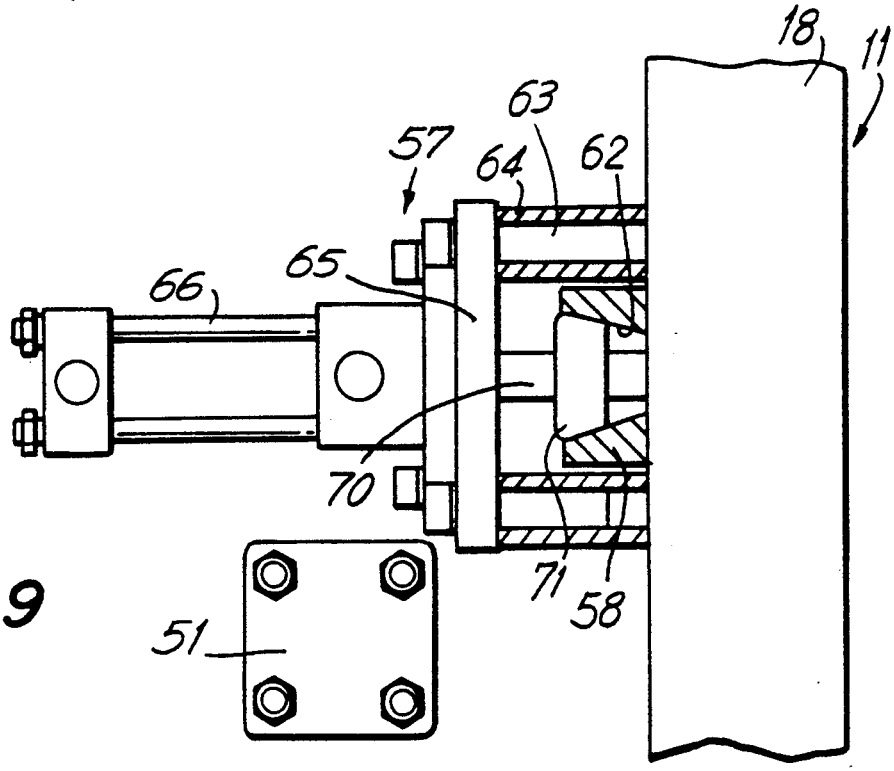
Figure 10:
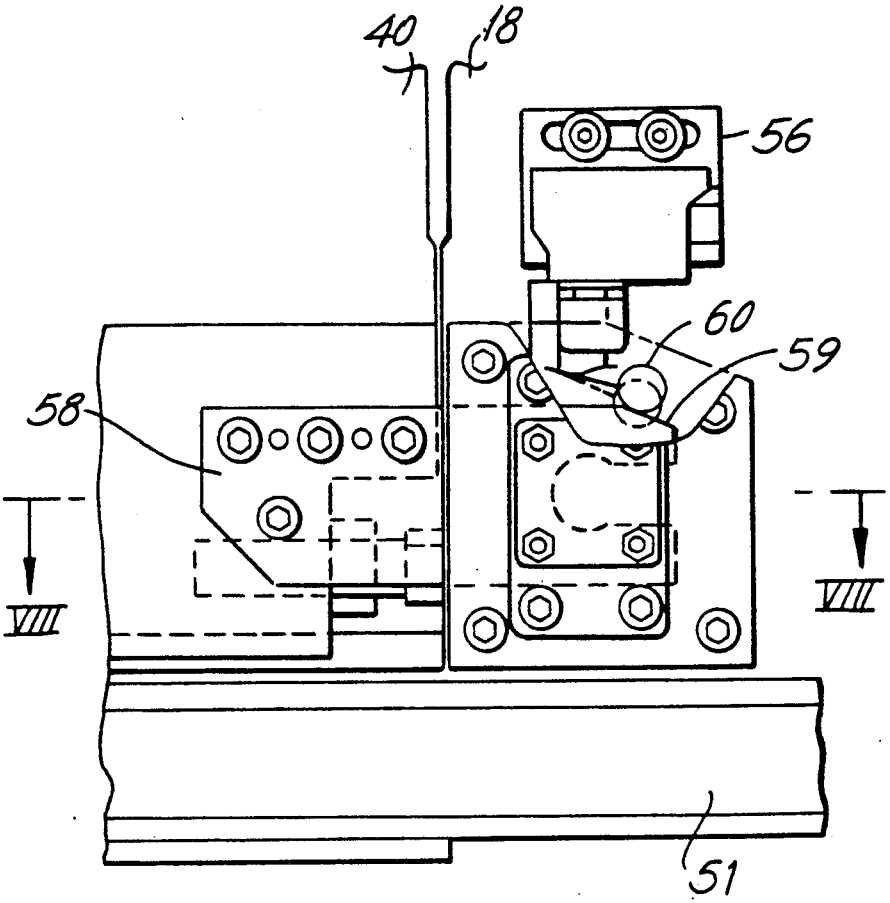

Linkage condition of the inker 13 with the main unit 11 is detected by a limit switch 56 (FIG. 10) disposed on the inner surface of the frame 18 and, in response to the detection, the inker 13 is fixed to the main unit 11 by a fixing device 57 (FIG. 8, FIG. 9) provided on the inner surface of the frame 18. These mechanisms are shown in FIG. 8 to FIG. 10.

On the inner surface of the front end (end at the main unit 11 side) of the inker frame 40 is mounted protrudingly a linking plate 58 which is part of the fixing device 57 and has a function as a dog to turn ON/OFF the limit switch 56. At the upper part of the front end of the linking plate 58 is formed an inclined surface 59 as a dog portion. The limit switch 56, mounted on the inner surface of the main unit frame 18, has a lever 60 facing the advancing end of the linking plate 58. Therefore, when the inker 13 is moved and linked to the main unit 11, the inclined surface 59 of the linking plate 58 pushes up the lever 60 to turn on (or off) the limit switch 56, thus detecting that the inker 13 is linked to the main unit 11.

At the front end of the linking plate 58 are formed a straight groove 61 and a tapered hole 62 connecting to the groove 61. When the inker 13 is linked to the main unit 11, the linking plate 58 is along the inner surface of the frame 18 of the main unit 11. With this condition, on a cylinder mounting 65 mounted, straddling the linking plate 58, on the inner surface of the frame 18 via a bolt 63 and a spacer 64 is mounted an inker fixing hydraulic cylinder 66 concentrically with the tapered hole 62. The frame 18 is provided with a hole 67 concentric with the tapered hole 62 under the above condition, and a cylindrical holder 69 having on the inner surface a bushing 68 is inserted in the hole 67. The front end of a rod 70 of the inker fixing hydraulic cylinder 66 engages slidably with the bushing 68, and a tapered fixing piece 71 engageable with the tapered hole 62 is mounted to the middle of the the rod 70. Thus, when the inker 13 is linked to the main unit 11, the inker fixing hydraulic cylinder 66 is extended to cause the fixing piece 71 to engage with the tapered hole 62 of the linking plate 58, thereby fixing the inker 13 to the main unit 11. A total of four fixing devices 57 are provided individually at the upper and lower sides of right and left connection sections between the main unit frames 11 and the inker frames 40.

Figure 12:
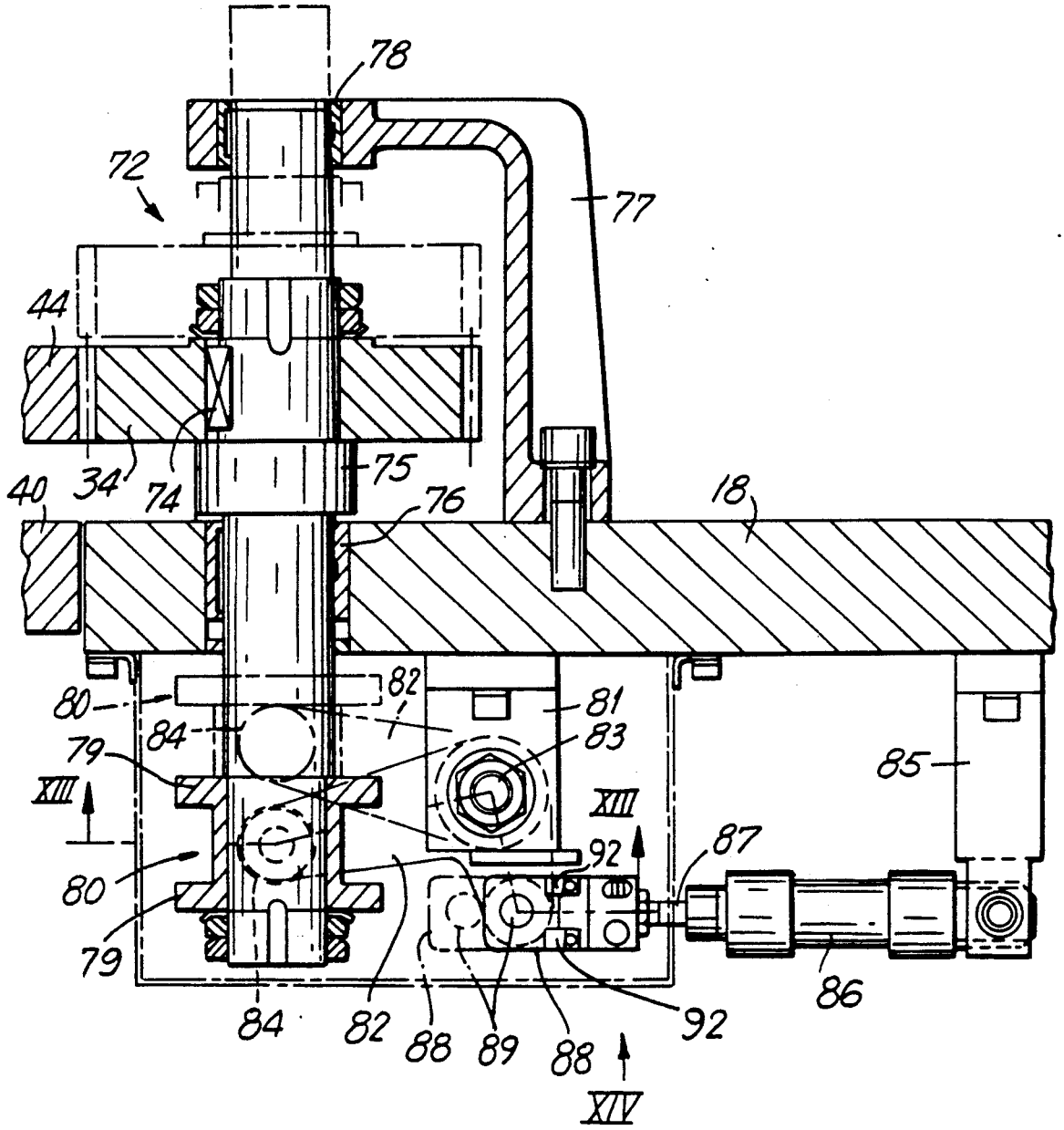
Figure 13:
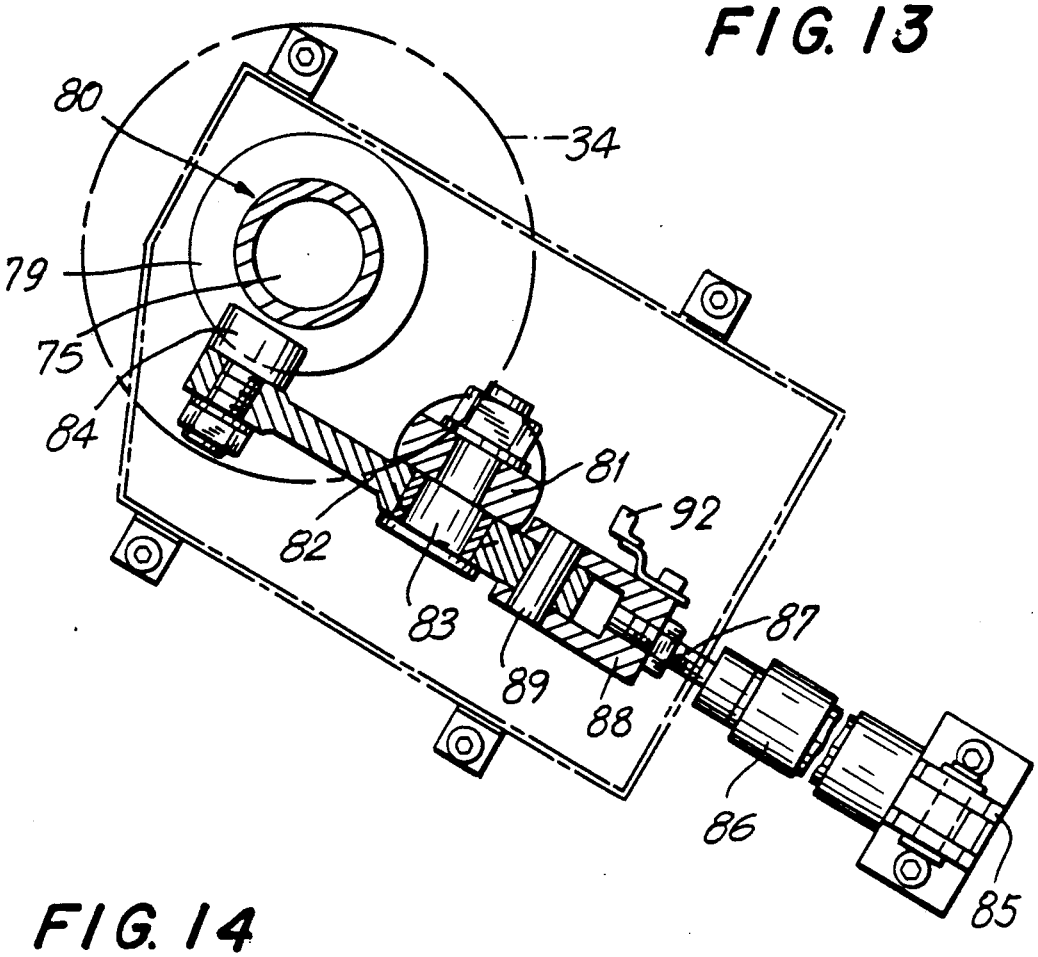

Engagement and disengagement between the driving gear 34 and the driven gear 44 in association with linkage and separation of the inker 13 with respect to the printing machine main unit 11 are made by a gear clutch device 72 shown in FIGS. 12 and 13.

As described above, and as shown in FIG. 11 showing part of the gear train, the driven gear 44 is supported rotatably but unmovably in the axial direction on a shaft 73 at the outside of the inker frame 40. On the other hand, as shown in FIG. 12, a gear shaft 75 to which is integrally mounted the driving gear 34 via a key 74 is supported rotatably and movably in the axial direction by a bearing member 76 attached to the main unit frame 18 and a bearing member 78 attached to a bracket 77 mounted to the outside of the frame 18. The end of the gear shaft 75 at the inside of the frame 18 is mounted a cylindrical movable member 80 having collars 79 at both ends. A bracket 81 is disposed in the vicinity of the gear shaft 75 at the inside of the frame 18, and on the bracket 81 is rotatably supported the corner portion of a bell crank-formed lever 82 by a pin shaft 83. At one end of the lever 82 is mounted a runner 84, which is engaged between the collars 79 of the movable member 80. On the other hand, a cylinder mount 85 is disposed on the inner surface of the frame 18, and rear portion of a clutch hydraulic cylinder 86 is attached to the cylinder mount 85. A connecting member 88 is mounted to the front end of a rod 87 of the hydraulic cylinder 86, and the connecting member 88 and the other end of the lever 82 are rotatably connected by a pin 89.

Figure 11:
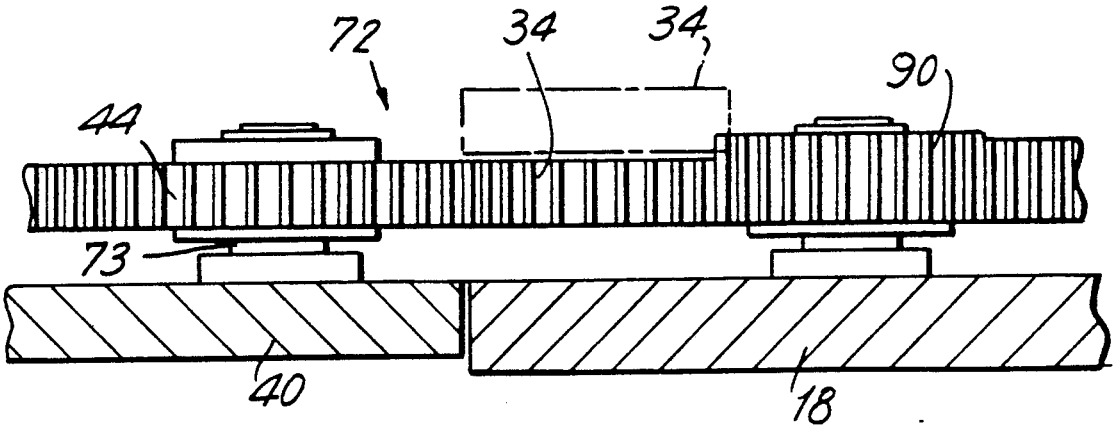

Therefore, by the operation of the clutch hydraulic cylinder 86, the lever 82 is swung, the gear shaft 75 is moved in the axial direction through the runner 84 and the collars 79, and engagement and disengagement of the driving gear 34 with respect to the driven gear 44 is achieved. In FIGS. 11 and 12, the driving gear 34 in the disengaged state is indicated by two-dot-bar lines. As shown in FIG. 11, the driving gear 34, even at the separated state from the driven gear 44, maintains a partial engagement with a neighboring gear 90 at the driving source side.

Portions of the driven gear 44 and the driving gear 34 for initial engagement is treated by so-called charring to sharpen the side edges of the teeth in order to achieve smooth engagement of both gears. However, even with the charring processing, the gears will not mesh edge to edge. Therefore, there is provided a phase-matching mechanism which aligns an edge of one gear with a valley of the other. The phase-matching mechanism comprises a detection device for detecting engagement condition between the driven gear 44 and the driving gear 34 and a control system.

Figure 14:
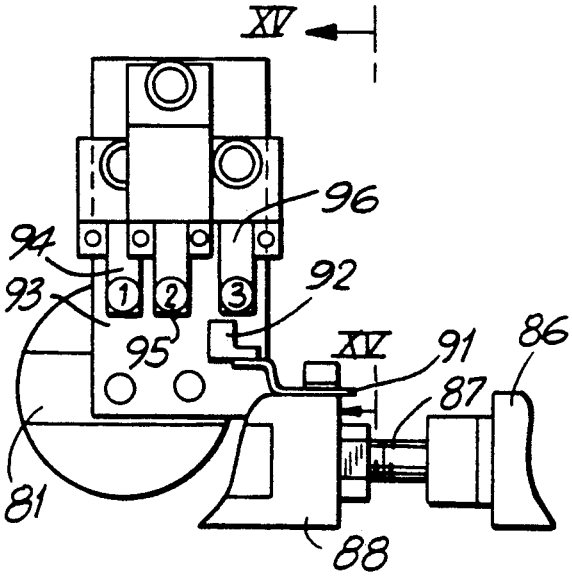
Figure 15:
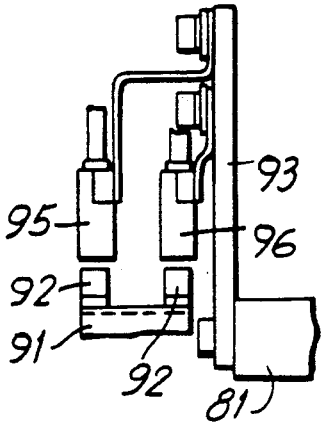

As shown in FIG. 12, FIG. 13, FIG. 14 viewed from the direction XIV in FIG. 12, and FIG. 15 viewed along line XV—XV in FIG. 14, a measurement piece 92 is attached to the connecting member 88 at the front end of the rod 87 of the clutch hydraulic cylinder 86 through a mounting plate 91. A supporting plate 93 is mounted onto the end face of the bracket 81, and three proximity switches 94, 95, and 96 for detecting the measurement piece 92 are supported by the supporting plate 93. As described above, since the driven gear 44 and the driving gear 34 are engaged or disengaged according to the extension or contraction of the rod 87 by the operation of the clutch hydraulic cylinder 86, the engagement condition of the gears 34 and 44 can be known from the dislocation of the measurement piece 92 on the connecting member 88 at the front end of the rod 87. With this arrangement, the proximity switch 94 detects the measurement piece 92 when the driving gear 34 is in the disengagement state with respect to the driven gear 44, the proximity switch 95 detects the measurement piece 92 when the driving gear 34 engages slightly with the driven gear 44, and the proximity switch 96 detects the measurement piece 92 when the driving gear 34 is completely engaged with the driven gear 44. Hereinafter the the switches 94, 95, and 96 are referred to as a first proximity switch 94, a second proximity switch 95, and a third proximity switch 96, respectively.

Signals detected by the first, second, and third proximity switches 94, 95, and 96 are inputted to a control system and, in response to these signals, the motor, the cylinders and the like are controlled. As the control system, this printing machine has a control panel which enables control over the entire linking and separation operations of the inker 13 and the main unit 11, in addition to the above operations.

As shown in FIG. 16, on a panel 97 of the control panel are disposed an inker forward instruction button switch 98, a withdrawal instruction button switch 99, a mode switch 100 for selecting interlocked, interrupted, or independent inker fixing operation, and a mode switch 101 for selecting interlocked, interrupted, or independent gear clutch operation. Furthermore, a clutch-on indication lamp 102 and a clutch-off indication lamp 103 are also disposed on the panel 97.

The printing machine main unit 11 or the inker 13 is provided with a buzzer to notify inker movement to operators. In addition to the limit switch 56 for detecting the inker forward limit, a limit switch for detecting the withdrawing limit is provided on the table 16 of the main unit 11.

Figure 2:
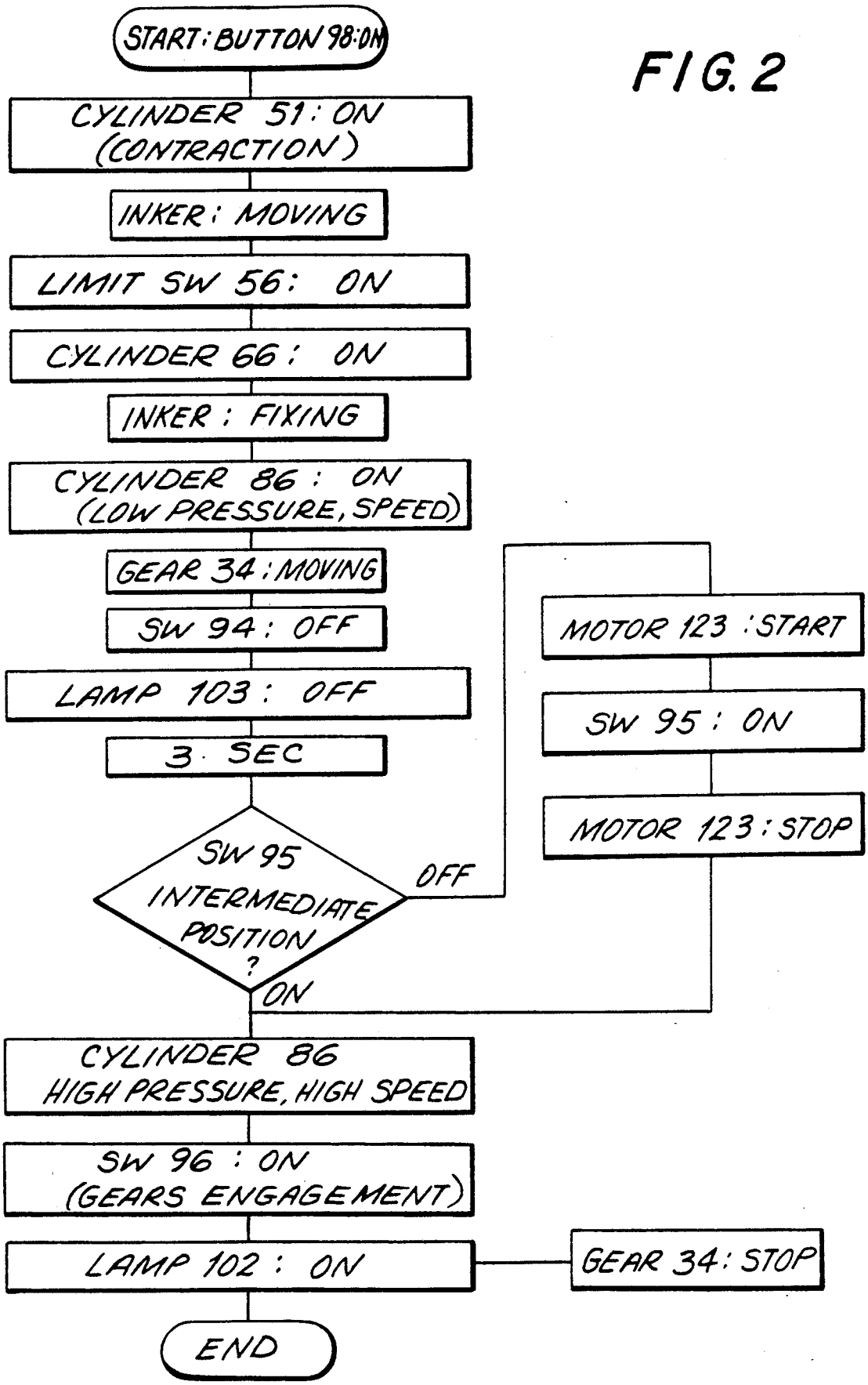
Figure 3:
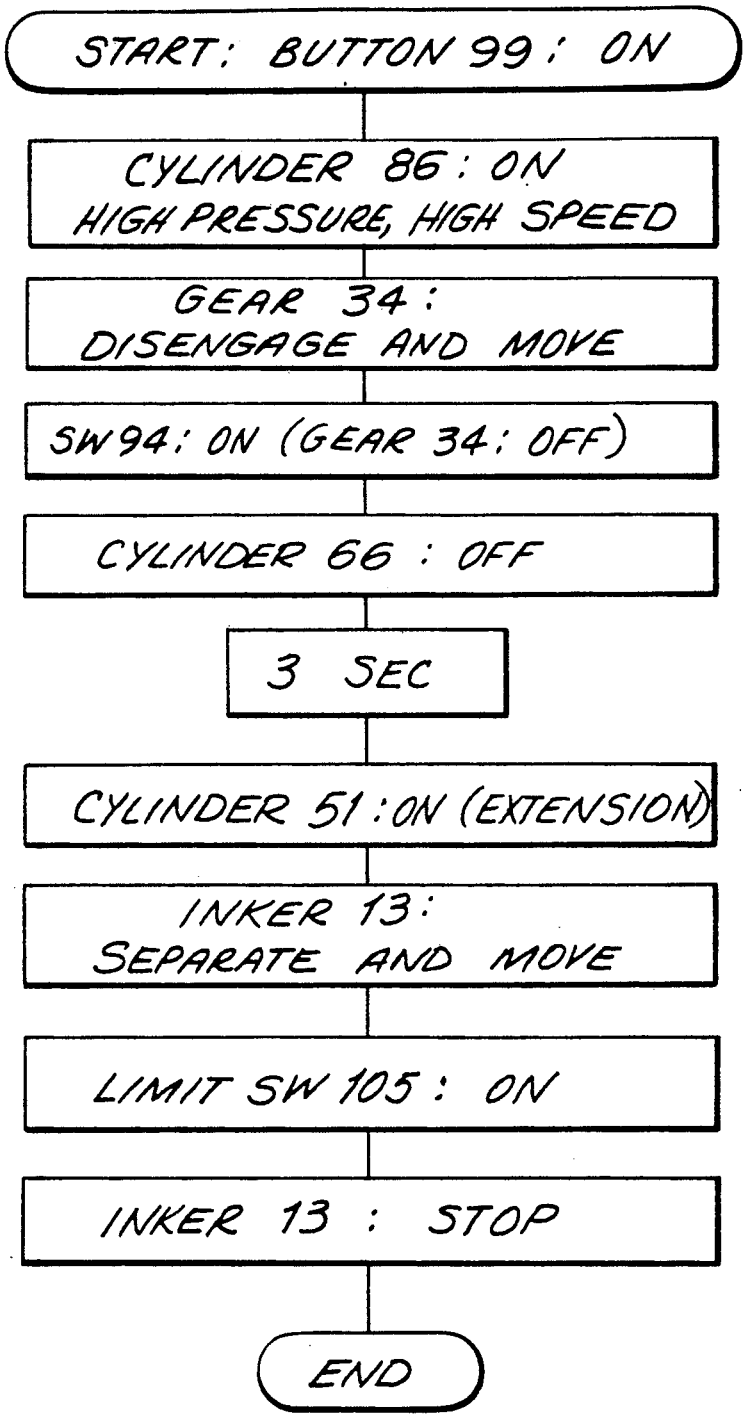

Control system of an embodiment will now be described with reference to FIG. 1, FIG. 2, FIG. 3, and FIG. 17. As described above, circuitry of the control system is as shown in FIG. 1. FIG. 2 is a flow chart of inker attachment in the interlocking mode, FIG. 3 is a flow chart of inker detachment, and FIG. 17 is a hydraulic circuit diagram of the clutch hydraulic cylinder 86.

Referring to FIG. 1, a line 104 is supplied with a voltage HI corresponding to a logic "1", and a common contact of the inker forward instruction button switch 98, the inker forward limit switch 56, and the inker fixing mode switch 100, a common contact of the clutch mode switch 101, the inker withdrawal instruction button switch 99, and an inker withdrawal limit switch 105 are connected to the line 104.

Output of the forward instruction switch 98 is connected to a set terminal S of a flip-flop circuit FF1, its Q-terminal output is connected to an input of a solenoid driving circuit 106, and its driving output is connected to a buzzer 107 and a rod contraction solenoid 109 of the inker moving hydraulic cylinder 51. Therefore, when the button switch 98 is once turned on to output a forward instruction, a hydraulic pressure is applied to the hydraulic cylinder 51 in the rod contraction direction until the FF1 is reset, to move the inker 13 forward. At the same time, the buzzer 107 sounds to give an alarm for inker movement. A reset terminal R of the FF1 is connected with output of a solenoid driving device 110.

Output of the inker forward limit switch 56 is connected to an input of a timer T1, and the timer output and the interlocking mode contact of the inker fixing mode switch 100 are connected to an input of an AND circuit AND1. Output of the AND1 is an inker fixing instruction, which is connected to an input of the solenoid driving circuit 110, and its driving output is connected to a rod extension solenoid 111 of the solenoid valve of the inker fixing hydraulic cylinder 66, and, as described above, to the reset terminal R of the FF1. In order to automate the inker withdrawal, the interlocking mode contact is connected to an input of an AND circuit AND7. The independent mode contact of the mode switch 100 also outputs an inker fixing instruction, which is connected in the form of wired-OR to an output of the AND1. The interruption mode contact is unconnected.

Therefore, in the interlocking mode, when the button switch 98 is turned on to move forward the inker 13, the limit switch 56 at the forward limit and, after the lapse of 3 seconds, a hydraulic pressure is applied in the rod extension direction of the hydraulic cylinder 66, the fixing device 57 begins to fix the inker 13 and, at the same time, the inker moving hydraulic cylinder 51 is stopped. The timer T1 is used to set a time required from turning-on of the limit switch 56 to the arrival of the inker 13 at a predetermined linking position. In the independent mode, since the flip-flop circuit FF1 remains reset, the inker 13 does not move, and the fixing device 57 operates alone. In the interruption mode, the fixing device 57 does not operate, and the inker 13 can only be moved by operating the button switch 98.

Output of the solenoid driving circuit 110 is connected to an input of a timer T2, and the timer output and the interlocking mode contact of the clutch mode switch 101 are connected to an input of an AND circuit AND2. Output of the AND2 is a clutch-on instruction, which is connected to an input of a solenoid driving circuit 112, and its driving output is connected to a rod contraction solenoid 113 of the solenoid value of the clutch hydraulic cylinder 86. The timer T2 is set, for example, to 3 seconds. To automate the release of inker fixing as described later, the interlocking mode contact is connected to one input of an AND circuit AND6. Also, the independent mode contact of the mode switch 101 outputs a clutch-on instruction, which is connected in wired OR with the output of AND2. The interruption mode contact is unconnected.

Therefore, in the interlocking mode, 3 seconds after the rod of the hydraulic cylinder 66 of the inker fixing device 57 extends to begin fixing of the inker 13, a hydraulic pressure is applied in the rod contraction direction to the hydraulic cylinder 86, and the inker 13 begins to be moved towards the clutch-on position where the driving gear 34 engages with the driven gear 44. In this case, the timer T2 is used as a device for confirming the fixing between the inker 13 and the main unit 11. In this embodiment, it has been confirmed that the inker 13 is completely fixed to the main unit within 3 seconds from the beginning of extension of the hydraulic cylinder 66. Of course, a detector such as a limit switch may alternatively used in place of the timer T2 to confirm the inker fixing. In the independent mode, regardless of inker fixing, the rod 87 of the hydraulic cylinder 86 contracts to move the driving gear 34 in the clutch-on direction. In the interruption mode, it is not moved.

Furthermore, outputs of the first proximity switch 94, the second proximity switch 95, and the third proximity switch 96 for detecting engagement condition of the driving gear 34 and the driven gear 44 are connected to inputs of detection circuits 114, 116, and 120, respectively.

The first proximity switch 94 is turned on only when the driving gear 34 is at the clutch-off position, and the detection circuit 114 outputs this condition as logic "1". Output of the detection circuit 114 is connected to the clutch-off indication lamp 103, an inverter 115, and the reset terminal R of a flip-flop FF2, and output of the inverter 115 is connected to one input of an AND circuit AND3. The other input of the AND3 is connected with output of the solenoid driving circuit 112, and output of the AND3 is connected to an input of a timer T3. Therefore, the timer T3 operates, while a clutch-on instruction is given, when output of the detection circuit 114 changes from the clutch-off position ("1") to non-detection ("0"). Output of the timer T3 is connected to one input of an AND circuit AND4 and one of three inputs of an AND circuit AND5. The timer T3 is set, for example, to 3 seconds.

The second proximity switch 95 is turned on only when the driving gear 34 is at an intermediate position where it engages slightly with the driven gear 44, and the detection circuit 116 outputs this condition as logic "1". Output of the detection circuit 116 is connected to the other input of the AND circuit AND4, and output of the AND4 is connected to a set terminal S of the flip-flop circuit FF2 and an inverter 117. Output of a terminal Q of the FF2 is connected to an input of a solenoid driving circuit 118, and its driving output is connected to a solenoid 119 of a pressure valve of the clutch hydraulic cylinder 86. Output of the inverter 117 is connected to an input of the 3-input AND circuit AND5. As shown in FIG. 17, the hydraulic circuit of the clutch hydraulic cylinder 86 comprises a solenoid valve 131 and a pressure valve 132. The solenoid valve 131 is moved up and down by the clutch-on solenoid 113 and a clutch-off solenoid 125 to contract or extend the rod. The pressure valve 132 temporarily increases the pressure from a contact value by the solenoid 119 to increase the cylinder force.

The third proximity switch 96 is turned on only when the driving gear 34 is at the clutch-on position, and the detection circuit 120 outputs this condition as logic "1". Output of the detection circuit 120 is connected to the clutch-on indication lamp 102 and an inverter 121, and output of the inverter 121 is connected to an input of the 3-input AND circuit AND5. Output of the AND5 is connected to an input of a buffer motor driving circuit 122, and its output is connected to a buffer motor 123.

Operations related to the first to third proximity switches 94 to 96 will now be described.

When the driving gear 34 is at the clutch-off position, the first proximity switch 94 is ON, and the clutch-off indication lamp 103 is lit. With this condition, when a clutch-on instruction is applied to the solenoid driving circuit 112, the solenoid 113 is energized, the rod 87 of the clutch hydraulic cylinder 86 begins to contract, the driving gear 34 begins to separate from the clutch-off position and move in the clutch-on direction, the first proximity switch 94 is turned off, and the lamp 103 goes out. At the same time, the timer T3 operates.

When the driving gear 34 moves in the clutch-on direction, if by chance it is aligned in phase with the driven gear 44, both gears 34 and 44 engages with each other, the driving gear 34 reaches the clutch-on position, and the clutch-on indication lamp 102 is lit. The moving time required for this operation is considered to be within 3 seconds in view of the speed of the hydraulic cylinder 86, and the timer T3 is set to 3 seconds.

Normally, since both gears are not aligned in phase, the driving gear 34 comes in contact against the driving gear 44 before the mid-point and cannot go further, and the period of 3 seconds runs with the second and third proximity switches 95 and 96 set off. After the elapse of 3 seconds, the AND circuits AND5 outputs an instruction to the buffer motor driving circuit 122 to operate the buffer motor 123, which causes the driving gear 34 to rotate at a low speed. By this rotation, when the driving gear 34 and the driven gear 44 are aligned in phase, the driving gear 34 again starts to move until it reaches the clutch-on position while engaging with the driven gear 44. This turns off the third proximity switch 96, the buffer motor 123 is stopped, and the lamp 102 is lit. In this embodiment, to prevent the gears from being damaged, the hydraulic cylinder 86 is operated at a low pressure and a low speed until both gears 34 and 44 are engaged. After the engagement, the hydraulic cylinder 86 is operated at a high pressure and a high speed to reduce the moving time and for positive holding of the clutch-on condition. For this purpose, when the second proximity switch 95 detects the driving gear 34 at the midpoint, the output of the AND circuit AND4 sets the flip-flop circuit FF2, and the solenoid driving circuit 118 operates the pressure solenoid 119.

When the inker 13 is set on the printing machine main unit 11 full-automatically, the mode switches 100 and 101 are both set to the interlocking mode, and the forward instruction button switch 98 is pressed. In this case, operation of the control system is as shown in the flow chart in FIG. 2.

Alternatively, with the clutch mode switch 101 set to the interlocking mode and the inker 13 moved to the forward limit by an appropriate method, the inker fixing mode switch 100 can be switched from the interruption mode to the independent mode to automatically perform the operations from inker fixing to clutch-on.

Further alternatively, with the mode switches 100 and 101 set to the interruption mode and the inker 13 moved to the forward limit by an appropriate method and fixed, the clutch mode switch 101 can be switched to the independent mode to automatically perform the clutch-on operation.

Attachment and detachment of the inker 13 will now be described. Referring to FIG. 1, output of the inker 13 withdrawal instruction button switch 99 is connected to a set terminal S of a flip-flop circuit FF3, and output of its output terminal Q is connected to individual inputs of the AND circuit AND6 and an AND circuit AND8. A reset terminal R of the FF3 is connected with output of the inker withdrawal limit switch 105.

As described above, the other input of the AND circuit AND6 is connected to the interlocking mode contact of the clutch mode switch 101, and output of the AND6 as a clutch-off instruction is connected to an input of a solenoid driving circuit 124. Output of the circuit 124 is connected to a rod extension solenoid 125 of the solenoid of the clutch hydraulic cylinder 86 and to a timer T4.

The timer T4 is set to approximately 3 seconds, and its output is connected to one input of the AND circuit AND7. As described above, the other input of the AND7 is connected with the interlocking mode contact of the inker fixing mode switch 100, and its AND output is connected to an input of a solenoid driving circuit 126. Output of the circuit 126 is connected to a rod contraction solenoid 127 of the solenoid valve of the inker fixing hydraulic cylinder 66 and to a timer T5.

The timer T5 is set, for example, to 3 seconds, and its output is connected to one input of the AND circuit AND8. The other input of the AND8 is connected, as described above, with the terminal Q output of the flip-flop FF3, and the AND output as an inker withdrawal instruction is connected to an input of a solenoid driving circuit 128. Output of the circuit 128 is connected to a buzzer 129 and a rod extension solenoid 130 of the solenoid valve of the inker moving hydraulic cylinder 51. The reset terminal R of FF3 is connected with output of the inker withdrawal limit switch 105.

To release the inker 13 from the printing machine main unit 11, the inker fixing and clutch mode switches 100 and 101 are set to the interlocking mode, and the withdrawal instruction button switch 99 can be pressed. As shown in FIG. 3, this causes the clutch hydraulic cylinder 86 to extend at a high pressure and speed, and the driving gear 34 begins to move towards the clutch-off position. After the lapse of 3 seconds from the beginning of moving, the inker fixing hydraulic cylinder 66 contracts, and fixing is released between the printing machine main unit 11 and the inker 13. After the lapse of 3 seconds from the beginning of the release, the inker moving hydraulic cylinder 51 extends and the inker 13 begins to withdraw. When the inker 13 reaches the withdrawal limit, the flip-flop circuit FF3 is reset and the operation stops. While the inker is moving, the buzzer 120 sounds to give an alarm. After the beginning of clutch-off, the lamp 102 goes out and, when the driving gear 34 reaches the clutch-off position, the lamp 103 is lit. At the same time, the flip-flop FF2 is reset, and hydraulic pressure of the clutch system is released.

The timers T4 and T5 are used as detectors for detecting inker release. In this embodiment, it has been confirmed that the driving gear 34 returns to the clutch-off position within 3 seconds from the beginning of movement and that the inker releasing is completed within 3 seconds from the movement.

In the above embodiment, the driving gear 34 moves between the clutch-off and clutch-on positions. Alternatively, however, the driven gear 44 may be arranged to move axially between the clutch-off and clutch-on positions and the driving gear 34 may be arranged to be rotatable but fixed axially, thereby obtaining the same clutch action.

Furthermore, the driving gear 34 is rotated at a low speed by the dedicated buffer motor 123 for phase matching at the time of clutch on. Alternatively, however, the printing motor 26 may be controlled instead of the motor 123 so as to rotate at a far slower speed than for printing to achieve phase matching, thereby obtaining the same effect.

Another embodiment of the present invention will now be described with reference to FIG. 18. A control system shown in FIG. 18 is the same as that shown in FIG. 1, except that inker moving is not fully automated, but the inker 13 is moved forward only while the button switch 98 is being pressed and is moved in reverse only while the button switch 99 is being pressed. This arrangement may sometimes be preferable in view of safety. Therefore, in FIG. 18, an AND circuit AND9 and an inverter 133 are used in place of the flip-flop circuit FF1 in FIG. 1, output of the forward instruction button switch 98 is connected to one input of the AND9, output of the inker forward limit switch 56 is connected to the other input of the AND9 through the inverter 133, and output of the AND9 as an inker forward instruction is supplied to the inker forward solenoid driving circuit 106. Similarly, in FIG. 18, an AND circuit AND10 and an inverter 134 are used in place of the flip-flop circuit FF3 in FIG. 1, output of the withdrawal instruction button switch 99 is inputted directly to the AND circuit AND6 and to one input of the AND10, output of the inker withdrawal limit switch 105 is connected to the other input of the AND10 through the inverter 134, and output of the AND10 is connected as an inker withdrawal instruction to the input of the AND8. Other circuit arrangement is the same as that in FIG. 1, and the operation flow is as shown in FIGS. 2 and 3.

With the first invention, with the movable gear at the clutch-off position and the inker moved forward manually of by an appropriate mechanical force to a position where the driving gear and the driven gear are engageable, a clutch-on instruction can be applied to achieve automatic engagement of both gears. Therefore, the need for visual phase matching of the gears is eliminated.

With the second invention, with the movable gear at the clutch-off position, an inker forward instruction can be applied to automatically perform a series of inker setting operations including inker forwarding and fixing, and gear engagement.

We claim:

1. A movable inker type printing machine comprising a printing machine main unit for a printing operation having a driving gear and a movable inker having a driven gear engaging with said driving gear, means for detaching said inker unit from said main unit, a motor for rotating said driving gear, a gear clutch device having, separate from said driving and driven gears, one movable gear disposed movably in the axial direction and a fixed gear disposed fixedly in the axial direction, said gear clutch device being responsive to a clutch-on instruction for moving said movable gear between a clutch-on position where said movable gear correctly engages with said fixed gear and a clutch-off position where said movable gear does not engage with said fixed gear, a device having means for outputting to said gear clutch device a clutch-on instruction to move said movable gear from said clutch-off position to said clutch-on position, a first detector having an output for detecting whether or not said movable gear is at said clutch-off position, a second detector for detecting engagement of said movable gear with said fixed gear, a timer having a time period commencing from an initial time-up position, means for operating said timer when the output of said first detector changes from detection of said clutch-off position to non-detection while said clutch-on instruction is being outputted, and a motor control device having means for operating said motor to rotate said driving gear at a lower speed than a speed for printing operation for said time period from the time-up of said timer to engagement detection of said second detector and for stopping said motor after detection of the engagement.

2. A movable inker type printing machine comprising a printing machine main unit for a printing operation having a driving gear and a movable inker having a driven gear engaging with said driving gear, means for detaching said inker unit from said main unit, a motor for rotating said driving gear, a gear clutch device having, separate from said driving and driven gears, one movable gear disposed movably in the axial direction and a fixed gear disposed fixedly in the axial direction, said gear clutch device being responsive to a clutch-on instruction for moving said movable gear between a clutch-on position where said movable gear correctly engages with said fixed gear and a clutch-off position where said movable gear does not engage with said fixed gear, an inker moving device responsive to an instruction for moving said inker between a forward position where said driven gear is engageable with said driving gear and a withdrawal position where said driven gear and said driving gear do not engage, an inker fixing device having means for fixing said inker at said forward position to said printing machine main unit and for releasing the fixing, a device having means for outputting an inker forward instruction to said inker moving device, an inker fixing instruction device for detecting the presence of said inker at said forward position and outputting an inker fixing instruction to said inker fixing device, a clutch-on instruction device for outputting a clutch-on instruction to said gear clutch device in response to said inker fixing instruction, a first detector having an output for detecting whether or not said movable gear is at said clutch-off position, a second detector for detecting engagement of said movable gear with said fixed gear, a timer having a time period commencing from an initial time-up position, means for operating said timer when the output of said first detector changes from detection of said clutch-off position to non-detection while said clutch-on instruction is being outputted, and a motor control device having means for operating said motor to rotate said driving gear at a lower speed than a speed for printing operation for said time period from the time-up of said timer to engagement detection of said second detector and for stopping said motor after detection of the engagement.

* * * * *